US009815290B2

(12) United States Patent
O'Reilly et al.

(10) Patent No.: US 9,815,290 B2
(45) Date of Patent: Nov. 14, 2017

(54) TRI-COLOR INK CARTRIDGE

(71) Applicant: Hewlett-Packard Development Company, L.P., Houston, TX (US)

(72) Inventors: Aidan O'Reilly, Leixlip (IE); Mark Walsh, Leixlip (IE); Garry Rooney, Leixlip (IE); Tommy O'Connor, Leixlip (IE); John Oliver, Leixlip (IE); Brendan Hall, Leixlip (IE); Willie Sheehan, Leixlip (IE); Stephen Byrne, Leixlip (IE); Michael Dineen, Leixlip (IE)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/110,038

(22) PCT Filed: Jan. 30, 2014

(86) PCT No.: PCT/US2014/013914

§ 371 (c)(1),
(2) Date: Jul. 6, 2016

(87) PCT Pub. No.: WO2015/116113

PCT Pub. Date: Aug. 6, 2015

(65) Prior Publication Data

US 2016/0332453 A1 Nov. 17, 2016

(51) Int. Cl.
*B41J 2/175* (2006.01)
*B41J 2/21* (2006.01)

(52) U.S. Cl.
CPC ..... *B41J 2/17553* (2013.01); *B41J 2/17513* (2013.01); *B41J 2/21* (2013.01)

(58) Field of Classification Search
CPC .... B41J 2/175; B41J 2/17503; B41J 2/17509; B41J 2/17513; B41J 2/17553; B41J 2/17559; B41J 2/21
See application file for complete search history.

(56) References Cited

U.S. PATENT DOCUMENTS 5,576,750 A * 11/1996 Brandon ..... B41J 2/17513 347/87
5,602,574 A 2/1997 Williams
(Continued)

FOREIGN PATENT DOCUMENTS

CN 1411990 4/2003
CN 101549585 10/2009

OTHER PUBLICATIONS

International Search Report and Written Opinion dated Sep. 29, PCT Patent Application No. PCT/US2014/013914 filed Jan. 30, 2014, European Patent Office.
(Continued)

*Primary Examiner* — Ahn T. N. Vo
(74) *Attorney, Agent, or Firm* — HP Inc. Patent Department

(57) ABSTRACT

A replaceable tri-color ink cartridge, comprising three chambers for different colors ink; a headland having headland slots each fluidically connected to a respective chamber; and a printhead die attached to the headland, the die including (i) nozzle arrays having a length of at least 14.3 millimeters, and (ii) feed slots that fluidically connect the headland slots to the respective nozzle arrays, wherein each headland slot is longer than the corresponding feed slot.

15 Claims, 6 Drawing Sheets

(56) References Cited

U.S. PATENT DOCUMENTS

| | | | | |
|---|---|---|---|---|
| 5,619,236 | A | 4/1997 | Keefe et al. | |
| 5,886,721 | A | 3/1999 | Fujii et al. | |
| 5,926,195 | A * | 7/1999 | Domhoff | B41J 2/17513 347/87 |
| 5,929,875 | A | 7/1999 | Su et al. | |
| 6,042,225 | A | 3/2000 | Altendorf et al. | |
| 6,260,961 | B1 * | 7/2001 | Seu | B41J 2/17503 347/87 |
| 6,286,932 | B1 | 9/2001 | Hirano | |
| 6,290,348 | B1 * | 9/2001 | Becker | B41J 2/17513 347/86 |
| 6,478,404 | B2 | 11/2002 | Torgerson et al. | |
| 6,749,295 | B2 | 6/2004 | Kim et al. | |
| 6,902,252 | B1 | 6/2005 | Torgerson et al. | |
| 7,195,347 | B2 | 3/2007 | Lee et al. | |
| 7,267,431 | B2 * | 9/2007 | Anderson | B41J 2/17513 347/20 |
| 7,281,783 | B2 | 10/2007 | Raman | |
| 7,377,618 | B2 | 5/2008 | Rivas et al. | |
| 7,494,215 | B2 | 2/2009 | Stellbrink | |
| 7,575,309 | B2 | 8/2009 | Childs et al. | |
| 7,690,760 | B2 | 4/2010 | Maher et al. | |
| 7,712,883 | B2 * | 5/2010 | Studer | B41J 2/17513 347/87 |
| 7,978,720 | B2 | 7/2011 | Fishbein et al. | |
| 8,262,204 | B2 | 9/2012 | Braun et al. | |
| 8,313,178 | B2 | 11/2012 | Studer et al. | |
| 8,857,960 | B2 * | 10/2014 | Ng | B41J 2/17513 347/87 |
| 2002/0027575 | A1 | 3/2002 | Bruch | |
| 2002/0109759 | A1 | 8/2002 | Usui et al. | |
| 2006/0001704 | A1 | 1/2006 | Anderson et al. | |
| 2006/0132563 | A1 | 6/2006 | Asai et al. | |
| 2007/0222837 | A1 | 9/2007 | Tajima | |
| 2009/0096851 | A1 | 4/2009 | Suiser | |
| 2009/0244181 | A1 | 10/2009 | Kurobe | |
| 2013/0106956 | A1 | 5/2013 | Ng et al. | |
| 2016/0332454 | A1 * | 11/2016 | O'Reilly | B41J 2/17513 |

OTHER PUBLICATIONS

Notification of Transmittal of International Preliminary Report on Patentability dated Feb. 2, 2016, CT Patent Application No. PCT/US2014/013914 filed Jan. 30, 2014.

* cited by examiner

TRI-COLOR INK CARTRIDGE

CLAIM FOR PRIORITY

The present application is a national stage filing under 35 U.S.C. §371 of PCT application number PCT/US2014/013914, having an international filing date of Jan. 30, 2014, the disclosure of which is hereby incorporated by reference in its entirety.

BACKGROUND

Tri-color ink cartridges with integrated printheads are manufactured and sold by multiple original equipment manufacturers. The housing contains ink chambers for inks of different colors. A printhead die having three nozzle arrays is adhered to a headland of the housing wherein each nozzle array is fluidically connected to one of the chambers. The housing is adapted to supply ink out of the chambers to the die.

DRAWINGS

DESCRIPTION

Figure 1:
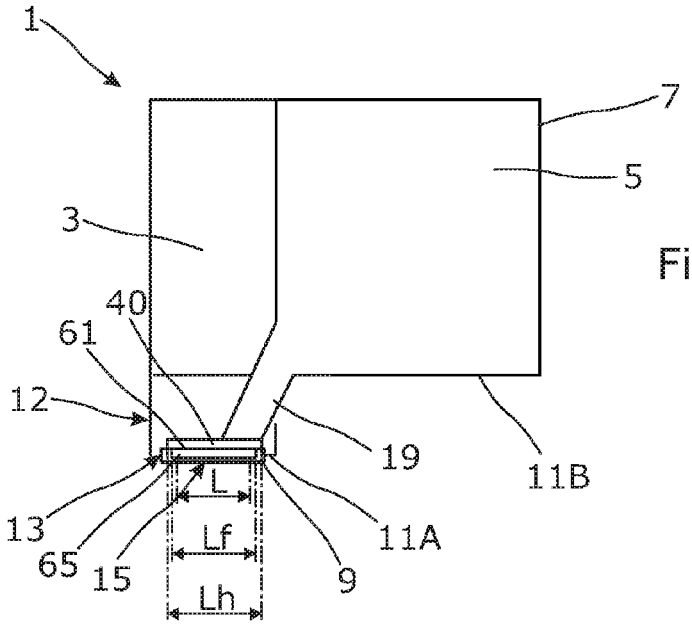
FIG. 1 illustrates a diagram of an example of a cartridge.

FIG. 1 illustrates an example replaceable tri-color cartridge 1 in a diagrammatic cross-sectional side view. The cartridge 1 includes three ink chambers 3, 5 each to contain a unique color ink, for example cyan, magenta and yellow. The example cartridge 1 includes two rear chambers 5 and one front chamber 3, one rear chamber 5 being disposed next to the other rear chamber 5 and hence, only one rear chamber 5 is visible in the side view. Ink, filters and capillary material may be disposed within each of the chambers 3, 5.

The cartridge 1 includes a housing 7. The housing 7 may form a single cast, injection molded, plastic shape for example including polyethylene, polyethylene terephthalate or another suitable polymer material. The cartridge 1 also includes a printhead die 9 attached to the housing 7. The cartridge 1 may include a lid on top of the housing 7 to seal the chambers whereas the lid may include a vent and a tear-off label sealing the vent. The housing 7 defines an "ink delivery system" of the cartridge 1 which includes the ink chambers 3, 5, standpipes 19, and other ink channel features.

A bottom of the housing 7 is stepped shaped, formed by (i) a lower bottom wall 11A that forms the headland, part of a protruding housing portion 12 that contains a front standpipe and rear standpipes 19, and (ii) a higher bottom wall 11B at a higher level than the lower bottom wall 11A and that defines bottoms of the rear chambers 5. The housing 1 includes a headland 13 to which the die 9 is attached. The headland 13 is part of the lower bottom wall 11A of the housing 1 and is at least partly disposed under the front chamber 3. The headland 13 may be defined by a pocket to accommodate positioning of the die 9. The pocket may be relatively shallow. The die 9 includes nozzle arrays 15 each to eject ink of one of the three ink colors. Each nozzle array 15 has a length L of at least approximately 14.3 millimeters, for example at least approximately 9/16 inch.

Figure 2:
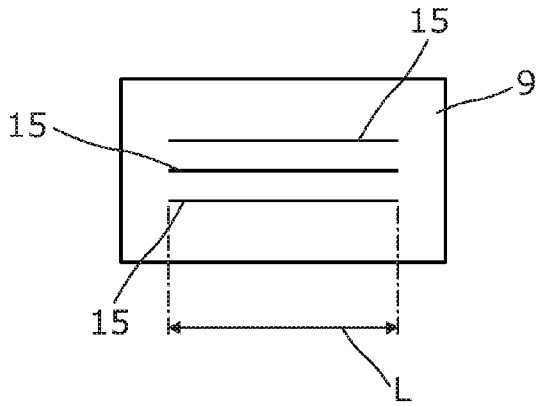
FIG. 2 illustrates a diagrammatic bottom view of an example of a die.
Figure 3:
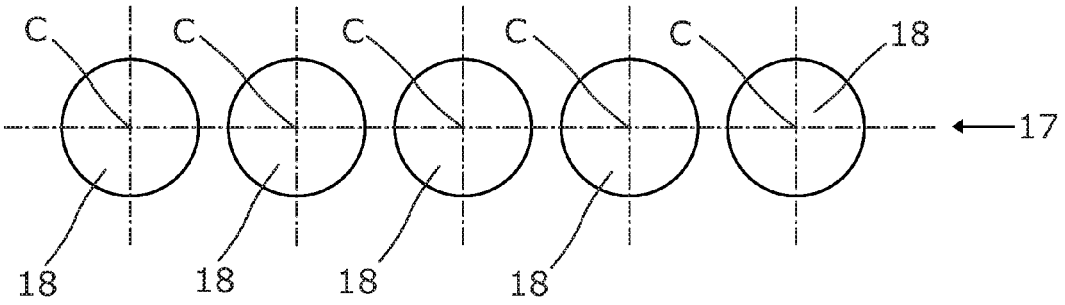
FIG. 3 illustrates a diagram of an example of a portion of a nozzle column.

An example of a bottom of the die 9 is illustrated in a diagrammatic bottom view in FIG. 2. The die 9 includes three parallel nozzle arrays 15, each nozzle array 15 being fluidically connected to a respective ink chamber 3, 5. Each nozzle array 15 may consist of at least one nozzle column 17, for example two nozzle columns 17. A small portion of one example nozzle column 17 is diagrammatically illustrated in FIG. 3, wherein five example nozzles 18 are illustrated. For example a full length nozzle column 17 comprises at least approximately 340 nozzles 18 in one column 17, for example 342 nozzles, and may have a length of approximately 14.4 millimeters. For example the pitch of the nozzles 18 in one column 17 is approximately 43 microns or less, for example approximately 42.3 microns or approximately 1/600 inch, the pitch being defined by the distance between centers C of neighboring nozzles 18 in one column 17. The nozzle arrays 15 may provide for a resolution of at least approximately 600 dots per inch. In an example a total nozzle array length L is measured between the centers C of outer nozzles 18 at the extremes of one column 17 which in one example would result in a total nozzle array length L of at least 14.3 millimeters, or at least approximately 14.4 millimeters, for example 342×42.33=14435.7 microns. For example, a corresponding swath width can be approximately 14478 microns, which includes an additional 42.33 microns for outer drops landing on media. The swath width can be defined as a maximum ink stroke width produced by a single sweep of the printhead die 9 over the media. The disclosed tri-color cartridge 1 may facilitate a relatively wide swath and hence, a relatively high print speed.

Back to FIG. 1, the standpipe 19 terminates in a plenum 40 that is located above the die 9. The plenum 40 is fluidically connected to the corresponding nozzle array 15. The bottom of the plenum 40 forms a headland slot 61 in the headland 13 and directly connects to an ink feed slot 65 of the die 9. In turn the ink feed slot 65 may supply ink to all of the nozzles 18 of the corresponding array 15. The headland slots 61 have a length Lh that is longer than the corresponding ink feed slot 65 to ensure continuous and sufficient supply of ink to the die 9. For example the length Lh of the headland slots 61 may be at least approximately 14.4 millimeters, or at least 14.8 millimeters, or at least approximately 15.5 millimeters, or at least approximately 15.9 millimeters. Each headland slot 61 fluidically connects directly with a die feed slot 65. For example, a length Lf of each die feed slot 65 is less than the length Lh of the headland slot 61 and more than a length L of the nozzle array 15. The headland slot 61 ensures a continuous supply of ink to the full length Lf of the feed slot 65, to the end that also outer extreme nozzles 18 can be supplied with ink at relatively high speeds and full swaths over relatively long periods.

Figure 4:
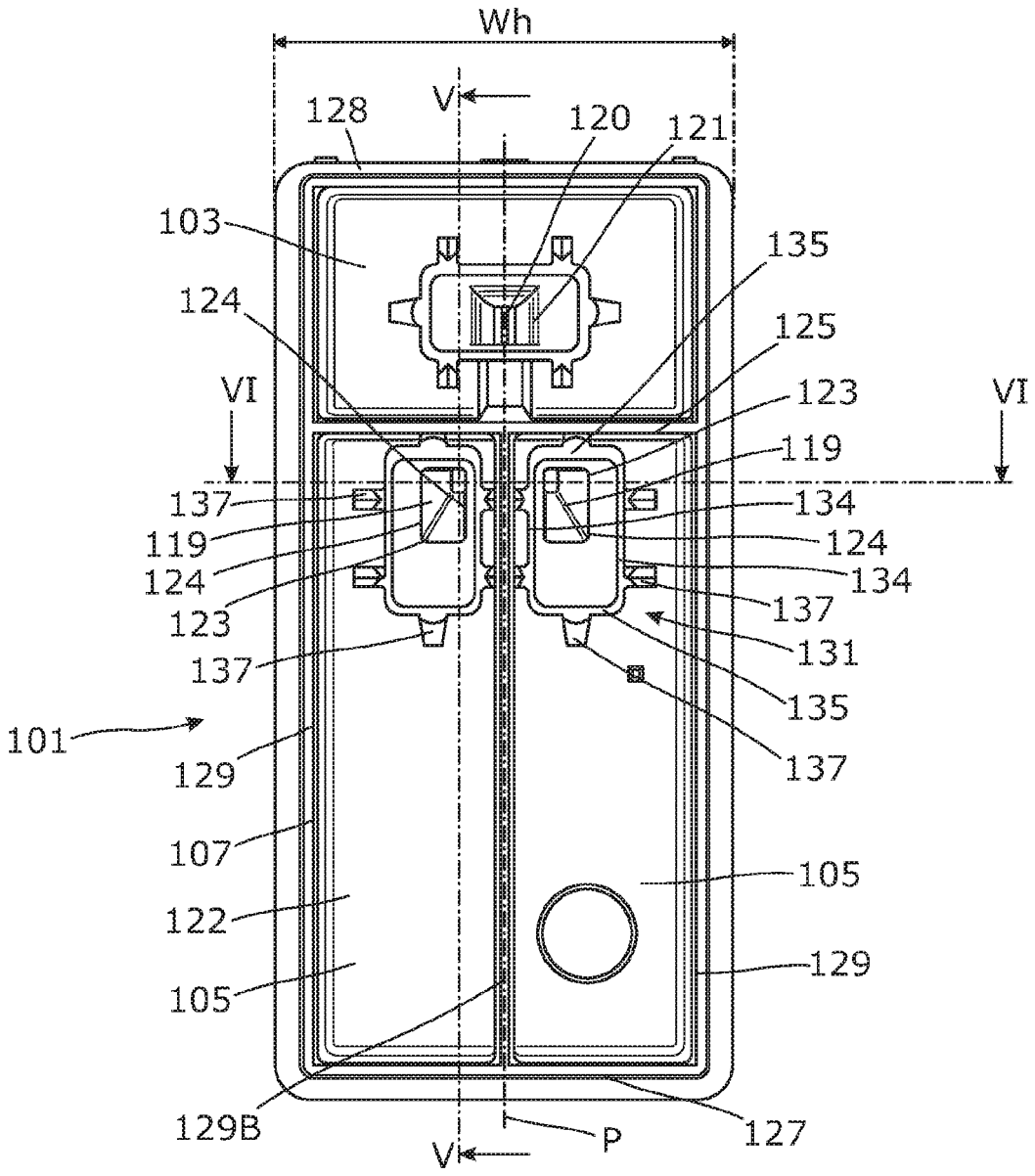
FIG. 4 illustrates a top view of an example of a cartridge without lid.
Figure 5:
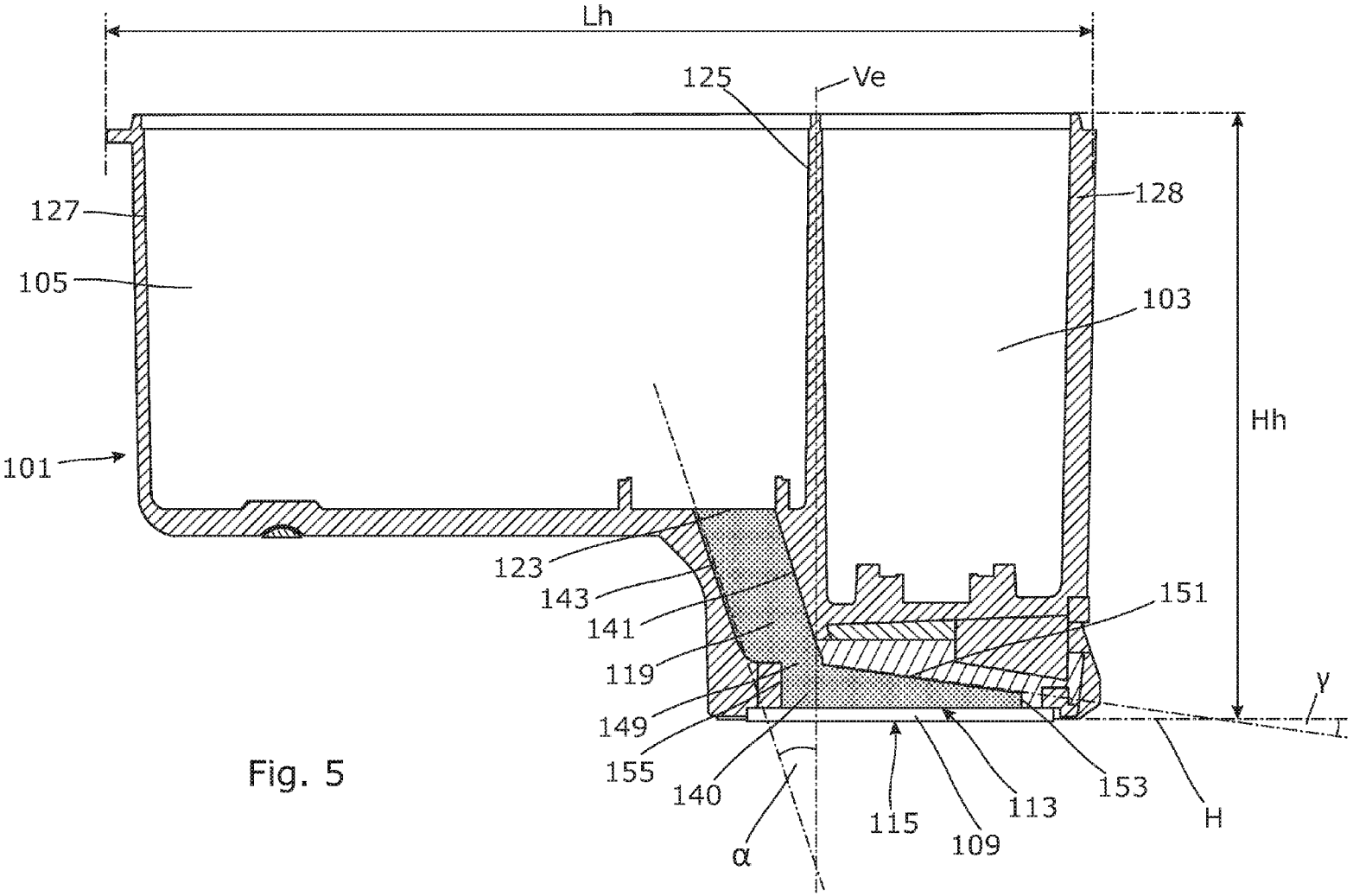
FIG. 5 illustrates a cross sectional side view of the example cartridge of FIG. 4.
Figure 6:
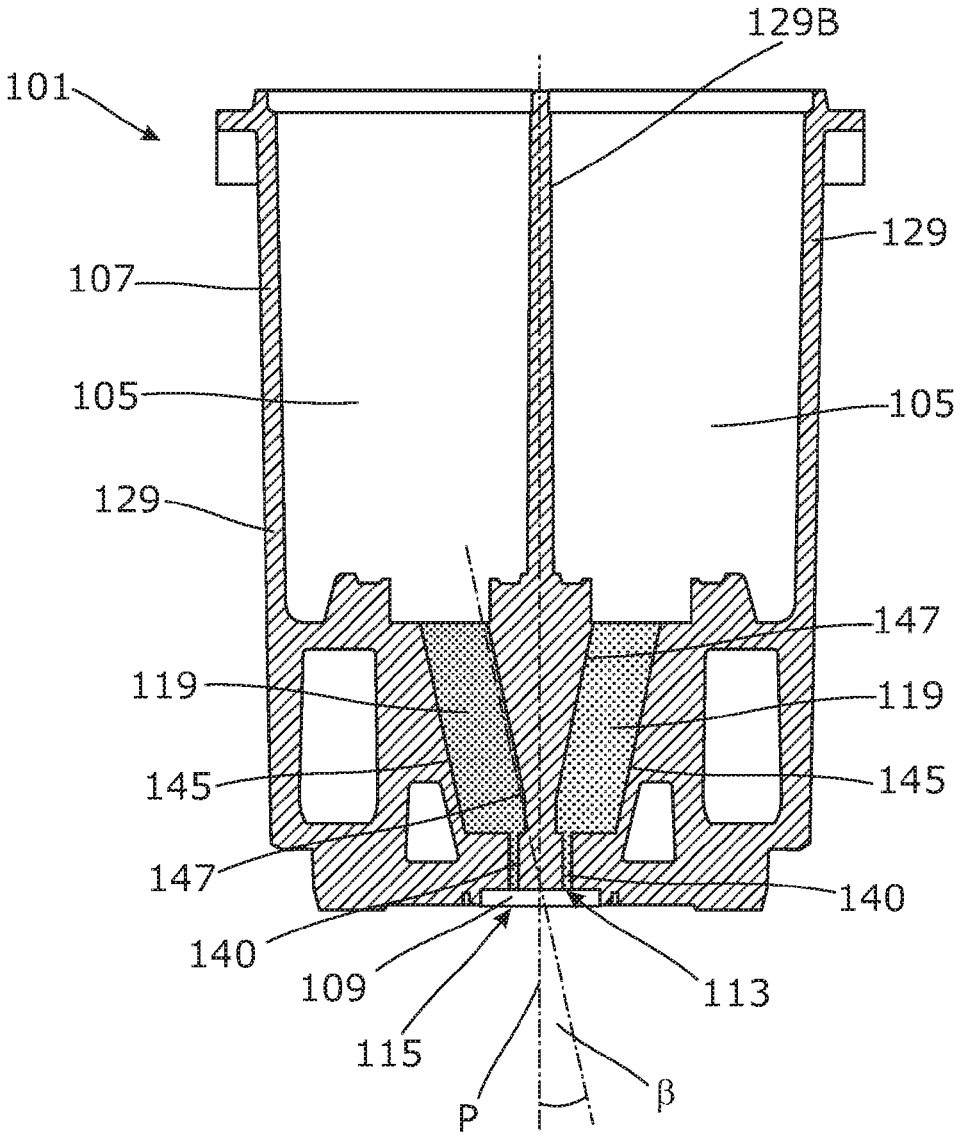
FIG. 6 illustrates a cross sectional front view of the example cartridge of FIGS. 4 and 5.

FIGS. 4-6 illustrate another example of a tri-color inkjet cartridge 101, in a top view, cross sectional side view and cross sectional front view, respectively. Certain components that may be included in the cartridge 101 such as a lid, a flexible circuit, capillary media, a filter and ink are omitted from the drawings.

The housing 107 includes two rear chambers 105 and one front chamber 103. For example the chambers 103, 105 of the example cartridge 101 of FIGS. 4-6 are to hold relatively large volumes of ink. For example, to accommodate more ink in the chambers 103, 105, the illustrated example housing 107 has a relatively long body. The inner volumes of the chambers 103, 105 can be at least approximately 10 cubic centimeters, for example at least approximately 10.5 cubic centimeters for the front chamber 103, and at least approximately 11 cubic centimeters or approximately 11022 cubic millimeters for the front chamber 103 and 11579 cubic millimeters for the rear chambers 105. For example the length Lh of the housing 107, as measured between outer extremes of a front wall 128 and a rear wall 127, is between approximately 61 and 71 millimeters, for example between approximately 63 and 69 millimeters, for example approximately 66 millimeters (FIG. 5).

In an example that is not illustrated the housing can have shorter outer dimensions, while maintaining relatively high ink volumes within its body. For a shorter housing body, such total length Lh could be between approximately 43 and 53 millimeters, for example between approximately 45 and 51 millimeters, for example approximately 48 millimeters. The chamber volumes of a shorter body can be at least approximately 7 cubic centimeters, for example at least approximately 9 cubic centimeters for the front chamber and at least approximately 7 cubic centimeters for the rear chambers, for example approximately 9526 cubic millimeters for the front chamber and approximately 7401 cubic millimeters for the rear chambers.

For example a total height Hh of the housing 107, as measured between a lowest and highest point of the cartridge housing 107, excluding a lid, can be between approximately 37 and 43 millimeters, for example approximately 40 millimeters (FIG. 5). A total width Wh of the housing 107 as measured between outer extremes of side walls 129 of the housing 107 can be between approximately 27 and approximately 37 millimeters, for example approximately 32 millimeters (FIG. 4).

Each of the rear chambers 105 has a front wall 125, a rear wall 127 and side walls 129, 129B wherein one side wall 129B of each of the rear chambers 105 serves as a partition wall 129B between the rear chambers 105. Each of the chambers 103, 105 is fluidically connected to a respective standpipe 117, 119. The standpipes 117, 119 open into a respective chamber 103, 105 via a standpipe entrance 121, 123. For example, the rear chamber standpipe entrance 123 is rectangular or trapezium shaped with rounded corners. Each rear chamber standpipe entrance 123 has two side edges 124 that are approximately parallel to at least one of the rear chamber side walls 129, 129B, for example approximately parallel to an imaginary vertical plane P running through the middle of the partition wall 29B. This may allow for a reduced mold complexity.

The housing 107 includes a filter mount 131 around the rear chamber standpipe entrance 123. The filter mount 131 is to support a filter. Such filter can be a flat metal mesh to remove impurities from the ink, for example a stainless steel mesh. The filter mount 131 includes ribs 134, 135. The ribs 134, 135 may have rounded corners and edges. The ribs 134, 135 protrude upwards from a bottom 122 of the chamber. The ribs 134, 135 of the filter mount 131 are arranged in a rectangular shape. Two side ribs 134 of the filter mount 131 extend parallel to the side walls 129, that is, to said vertical plane P, and transverse ribs 135 of the filter mount 131 may extend approximately parallel to the rear and front wall 127, 125 of the rear chamber 105, or parallel to a vertical plane Ve that runs vertically through the front wall 125. In this example, the side ribs 134 are longer than the transverse ribs 135. For example, each filter mount 131 has additional rib protrusions 137 that protrude over a short distance at an approximately straight angle from a respective rib 134, 135. The side ribs 134 are provided with two rib protrusions 137 each, protruding approximately parallel to the front and rear wall of the chamber 105, and the transverse ribs 135 are provided with one rib protrusion 137 each, protruding approximately parallel to the side walls 129.

As best illustrated in FIGS. 5 and 6 a standpipe 119 is provided to supply ink out of a respective rear chamber 105 to a corresponding nozzle array 115. A front standpipe 120 is fluidically connected to the front chamber 103. In this disclosure mainly the ink delivery components connected to the rear chambers 105 will be addressed. The rear chamber standpipe 119 opens into the chamber 105 at the standpipe entrance 123 at one end and into a plenum 140 above the nozzle array 115 at an opposite end. The standpipe 119 may have a trapezium shaped horizontal cross section similar or equal to earlier mentioned entrance 123. The standpipe 119 has substantially straight front and rear pipe walls 141, 143 that are inclined with respect to a vertical Ve under an angle $\alpha$. The vertical Ve may extend through the front wall 125 of the rear chamber 105. As best illustrated in FIG. 5, the angle $\alpha$ of the front and rear pipe walls 141, 143 can be between approximately 5 and 23.5°. For example, the angle $\alpha$ of the front and rear pipe walls 141, 143 of a short body housing (not illustrated) can be between approximately 5 and 15°, or approximately 9.8°. For example, the angle $\alpha$ of the front and rear pipe walls 141, 143 of a long body housing 107 (illustrated) can be between approximately 13.5 and 23.5°, or approximately 18.5° for the illustrated long body housing 107.

The rear standpipes 119 have approximately parallel side walls 145, 147 that are inclined with respect to an imaginary vertical plane P that cuts through the partition wall 1296. The angle $\beta$ of the pipe side walls 145, 147 with respect to the plane P is between approximately 7° and 17°, or between approximately 9° and 15°, or approximately 12°, as best illustrated in FIG. 6. The sloping walls of the standpipe 119 may aid in allowing bubble and gas release in a direction upwards along the pipe walls 141, 143, 145, 147, while conveniently connecting and fitting to other ink delivery system components within the housing 107. The substantially parallel pipe walls 141, 143, 145, 147 may allow for a single angled mold insert to extend through, and form, the entire standpipe 119 including the standpipe end opening 149.

The standpipe 119 opens into a plenum 140. The plenum 140 opens into an ink feed slot of the die 109. The feed slot may be a trench in the die 109 that supplies the ink to the nozzles. The plenum 140 has a relatively large volume of at least approximately 10 cubic millimeters or for example at least approximately 14 cubic millimeters, for example approximately 14.86 cubic millimeters. The relatively large volume of the plenum 140 allows for supplying relatively large ink volumes directly to the feed slots of the die 109. These relatively large plenum volumes aid in supplying the ink to the relatively long nozzle array 15, to print at relatively wide swaths, even at a high firing frequency if necessary.

The plenum 140 has an inclined ceiling 151 that slopes downwards from a standpipe end opening 149 up to a front wall 153 of the plenum 140. The entire ceiling 151 may be sloped. The front wall 153 extends straight upwards from the headland 113 up to the ceiling 151, at a straight angle with the headland 113. The angle γ of the inclined ceiling 151 with respect to a horizontal H is between approximately 7.8 and approximately 15°, for example between approximately 8 and 11°, for example approximately 8°. The fact that the entire ceiling 151 inclines over said angle γ facilitates that bubbles are able to readily travel over the length of the ceiling 151 and reach the standpipe 119. An angle γ close to 8° may allow for a relatively higher plenum front wall 153, and consequently a higher volume of the plenum 140, while still facilitating bubble migration away from the die 109. It was found that, for certain usage scenarios, a ceiling angle γ outside of said range of 7.8 to 15° could affect bubble migration.

The plenum front wall 153 may have a Height Hf of at least approximately 0.7 millimeters, for example at least approximately 0.9 millimeters, for example approximately 0.94 millimeters. The plenum 140 is further defined by a straight rear wall 155 at a straight angle with the headland 113, extending from the headland 113 up to the standpipe 119. The plenum rear wall 155 has a height Hr of at least 2.5 millimeters, for example at least 2.8 millimeters, for example approximately 2.89 millimeters. The plenum rear wall 155 forms a boundary of the standpipe end opening 149. The standpipe end opening 149 is provided at the rear end of the plenum 140.

The mentioned angles and arrangement of the standpipe and plenum walls may make optimal use of the limited space available in the housing 107, within given dimensional constraints, while (i) facilitating continuous and relatively high ink flow, (ii) aiding in bubble travel and (iii) allowing for reduced mold complexity for example with a minimum of inserts.

Figure 7:
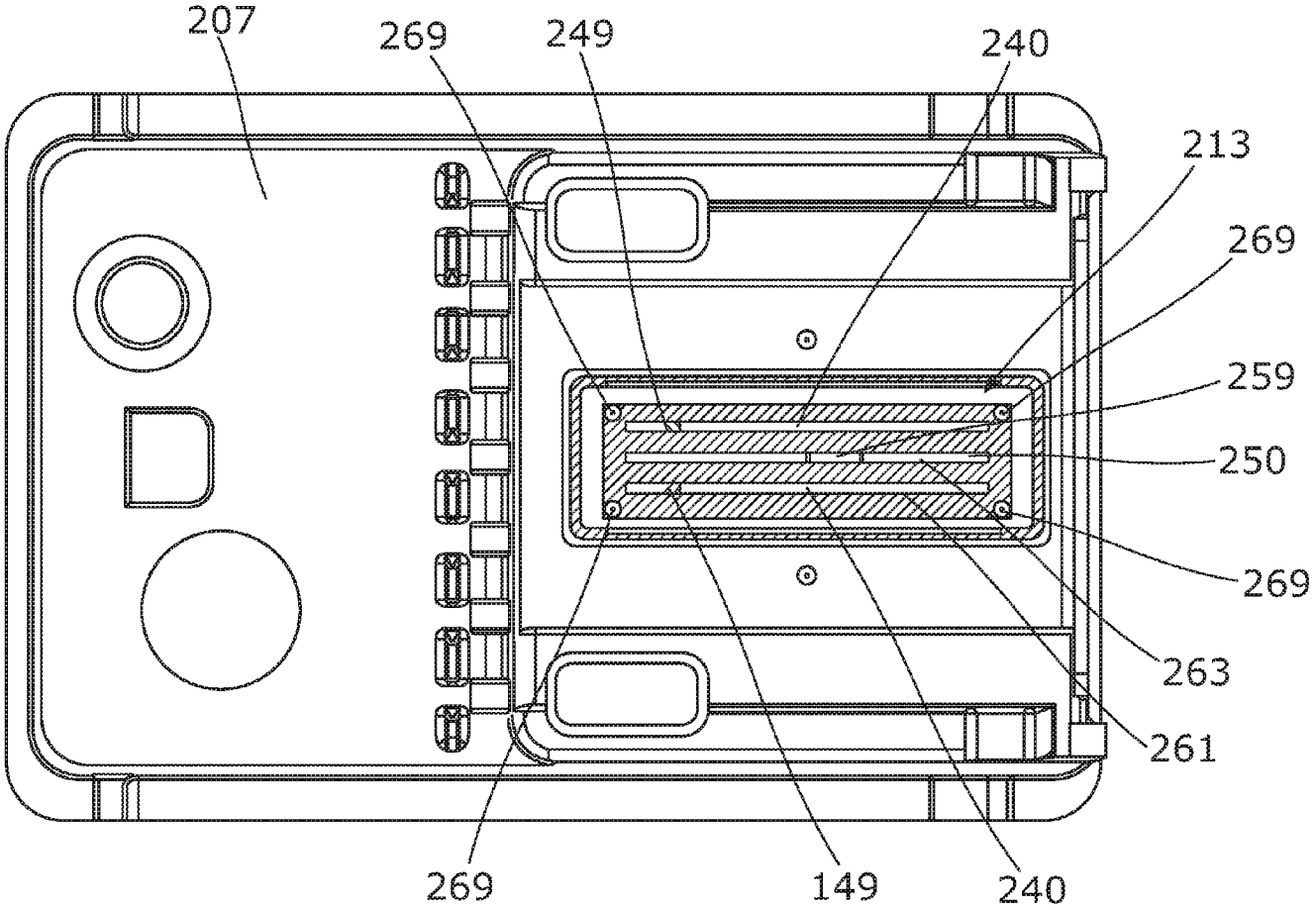
FIG. 7 illustrates a bottom view onto an example of a cartridge housing without die.

FIG. 7 is a bottom view on a headland 213 of a shorter body housing 207. The headland design may correspond to the headland 213 of FIGS. 4-6, while the housing 207 may be slightly shorter than the housing 107 of FIGS. 4-6 for example due to certain constraints determined by the printer or a desired ink volume. In FIG. 7, the plenums 240 of the rear chambers and the plenums 250 of the front chamber are illustrated. The standpipe end openings 249 of the rear standpipes open at the rear end of the respective plenums 240. The standpipe end opening 259 of a front standpipe opens closer to a middle of the plenum 250, for example slightly off-centered towards the front.

Figure 8:
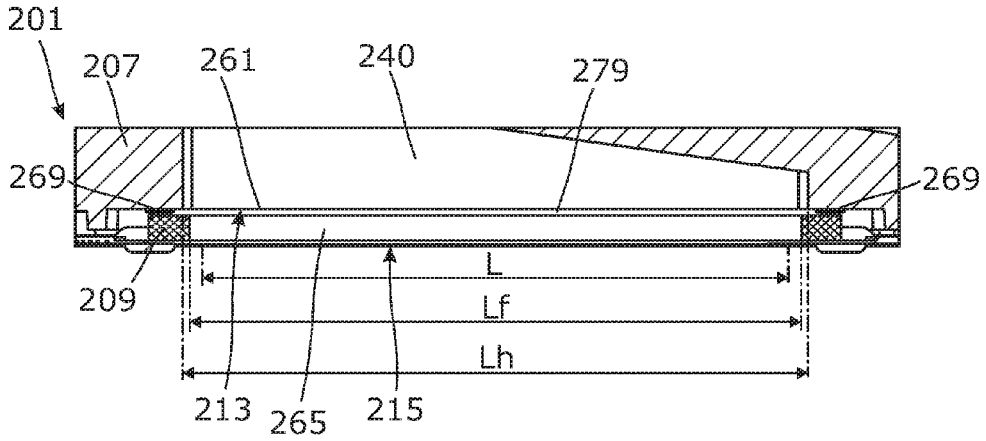
FIG. 8 illustrates a cross sectional side view of a detail of the example cartridge housing of FIG. 7 with die.

FIG. 8 is a cross sectional side view of a detail of the cartridge 201 of FIG. 7, wherein the die 209 is attached to the headland 213 of the housing 207. As illustrated in FIGS. 7 and 8, the headland 213 includes separate protrusions 269. The protrusions 269 are to engage the die in an attached condition of the die. The protrusions 269 may serve as stand-offs, to retain the die in a predetermined position while controlling adhesive bead properties. FIG. 8 diagrammatically illustrates, in a cross sectional side view, a portion of the die 209 engaging such protrusion 269. At manufacturing stage adhesive may be applied around and between the headland slots 261, 263 for adhering the die 209. Thereby die 209 may be placed against the protrusions 269 to ensure a straight positioning irrespective of a possible variation in the thickness of the adhesive bead. The protrusions 269 may be shaped as bumps, for example having a height of at least approximately 0.08 millimeters, or at least approximately 0.1 millimeters, or approximately 0.12 millimeters. For example the protrusions 269 may be round or rectangular of shape, and may have a maximum width or diameter of less than approximately 2 millimeters or less than approximately 1 millimeter, as seen from a direction perpendicular to the headland surface. The protrusions 269 may be located near the longitudinal ends of the die 209. The headland 213 may include four such protrusions 269 each at a far corner near an outside of an outer extreme of the outer headland slots 261 to not interfere with the adhesive bead. Correspondingly, the protrusions 269 engage the die 209 near an outside of an outer extreme of the outer ink feed slots 265. The die 209 is disposed against the protrusions 269, leaving a space 279 between the die 209 and the rest of the headland 213 for the adhesive bead. The adhesive bead surrounds the headland and feed slots 261, 265 and therewith provides for a seal around the slots 261, 265. The space 279 created by the protrusions 269 may allow for a relatively equal spread of the adhesive bead which in turn may provide for a more reliable seal between the die 209 and the headland 213 and/or a better controlled positioning of the die 209. In certain examples, a reliable adhesive seal and a precise die position may be critical. In addition a "press-fit" of the printhead die 209 to the headland 213 may be prevented. Rather the die 209 can be placed to the protrusions 269 under relatively low pressure to prevent damage to the die 209. In one example contact areas of the die 209 substantially consists of SU8 material, which may be relatively fragile.

As best illustrated in FIG. 8, the edges of the bottoms of the plenums 240, 250 form headland slots 261, 263, respectively, in the headland 213 and directly connect to ink feed slots 265 of the die 209. In turn the ink feed slots 265 supply ink to the nozzles. The headland slots 261, 263 have a length Lh that is longer than a corresponding ink feed slot 265 to ensure continuous and sufficient supply of ink to the die 209. For example the length Lh of the headland slots 261, 263 may be at least approximately 14.4 millimeters, or at least 14.8 millimeters, or at least approximately 15.5 millimeters, or at least approximately 15.9 millimeters. Each headland slot 261, 263 fluidically connects directly with a feed slot 265. A length Lf of each die feed slot 265 is less than the headland slot 261, 263 and more than a length of the nozzle array 215. For example the length Lf of the die feed slot 265 is at least approximately 0.1 millimeter shorter than the headland slot 261, 263 or at least approximately 0.15 millimeters shorter than the headland slot 261, 263, or approximately 0.17 millimeters shorter than the headland slot 261, 263, for example between approximately 14.7 and approximately 15.8 millimeters, or between approximately 15.4 and approximately 15.7 millimeters or approximately 15.6 millimeters.

Figure 9:
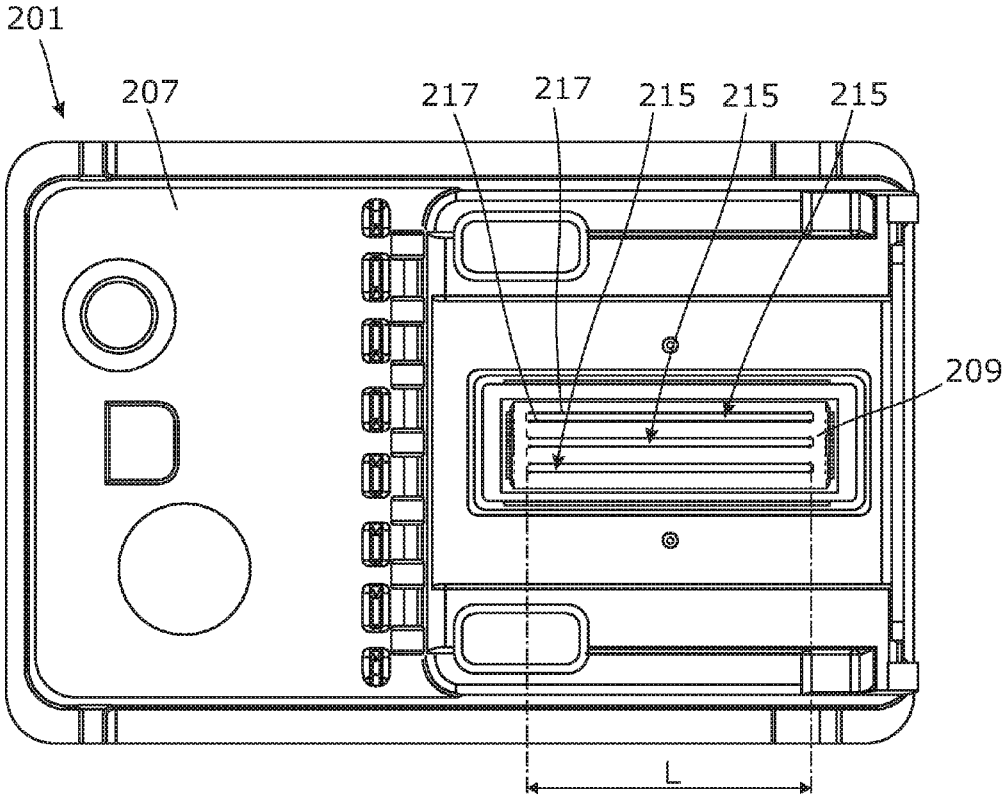
FIG. 9 illustrates a bottom view of the example cartridge housing of FIGS. 7-8 with die.

As illustrated in FIG. 9, each single color nozzle array 215 may include two nozzle columns 217. The length of each column 217 is the same as the length L of the nozzle array 215. In an example the nozzle array length L is measured between the centers of the outer nozzles 19 at the extremes of each column 217. For example, the nozzle array length L and corresponding swath width can be at least approximately 14.3 millimeters or at least approximately 14.4 millimeters, or approximately 14435.7 microns. A resulting swath width as printed on paper can be at least approximately 14.4 millimeters, or approximately 14478 microns. For example, each column 217 may consist of 342 nozzles, having a distance of approximately 1/600 inch resulting in a 600 dpi (dots per inch) resolution.

The disclosed components of the cartridge 1, 101, 201 may facilitate relatively high print speeds and/or wider swaths while being able to deliver a desired print quality and resolution. For example, the die 9, 109, 209 is to print at at least approximately 600×600 dpi at a speed of at least approximately 40 ips (inch per second), firing at a frequency of at least approximately 20 kHZ, for example approximately 24 kHZ. The relatively wide swath may accommodate faster print speeds and/or more coverage at a given swath. The housing 7, 107, 207 may accommodate a constant supply of ink over the full length of the nozzle array 15, 115, 215 at these relatively high speeds. The housing 7, 107, 207 may also accommodate bubble migration while supplying the ink, leading to longer printhead life and better prints. In addition, the housing 7, 107, 207 may be manufactured relatively cheaply, that is, with molds of reduced complexity. The housing 7, 107, 207 may have outer dimensional constraints determined, for example, by a corresponding printer within which constraints relatively high ink volumes may be housed.

In this disclosure, certain terms relating to a certain orientation or position within the cartridge like bottom, rear, front, vertical, horizontal, etc. may refer to the cartridge in an upright orientation as illustrated. However, these terms are to be interpreted as relative terms for explanative purposes only, and are not meant to limit the cartridge to one operational orientation. In principle, the cartridge or housing can operate in any orientation, for example for handheld printing purposes or for printing on vertical surfaces. For example, a bottom may actually extend vertically at a side when printing vertically and, similarly, a vertical plane P may actually extend horizontally.

It should be understood that "parallel" surfaces or surfaces at "straight" angles may not be 100% accurate. Error margins may be present for example as a result of mold release angles and/or other manufacturing tolerances.

As noted at the beginning of this description, the examples shown in the figures and described above illustrate but do not limit the invention. Other examples are possible. Therefore, the foregoing description should not be construed to limit the scope of the invention, which is defined in the following claims.

What is claimed is:

1. A replaceable tri-color ink cartridge, comprising
three chambers for different colors ink;
a headland having three headland slots each fluidically connected to a respective chamber; and
a printhead die attached to the headland, the printhead die including
nozzle arrays, wherein each nozzle array comprises at least approximately 340 nozzles in one column, having a nozzle pitch of approximately 43 microns or less, or each nozzle array provides for a resolution of at least approximately 600 dots per inch, and
three feed slots that fluidically connect the headland slots to the respective nozzle arrays, wherein a length of each headland slot is larger than a length of the corresponding feed slot and the length of the feed slot is larger than a length of the nozzle array.

2. The cartridge of claim 1 wherein the cartridge comprises a standpipe opening into the respective chamber at one end and into a plenum at an opposite end, the plenum defining the headland slot, and a volume of the plenum is at least 10 cubic millimeters.

3. The cartridge of claim 2 wherein said volume is at least 11 cubic millimeters or at least 14 cubic millimeters.

4. The cartridge of claim 2 wherein the plenum has an inclined ceiling that slopes downwards from the standpipe, the ceiling having a slope of between approximately 8 and 11 degrees with respect to a horizontal, in an upright orientation of the cartridge.

5. The cartridge of claim 4 wherein the slope is approximately 8 degrees.

6. The cartridge of claim 4 wherein the plenum ceiling is terminating at a straight wall at a front end and at the standpipe at an opposite end.

7. The cartridge of claim 6 wherein the straight wall extends inwards from the headland at an approximately straight angle with the headland, having a height between the headland and the inclined ceiling of at least 0.7 millimeters.

8. The cartridge of claim 6 wherein an opposite straight wall extends inwards from the headland at an approximately straight angle with the headland, up to the standpipe, having a height between the headland and the standpipe of at least 2.5 millimeters.

9. The cartridge of claim 2 wherein the standpipe comprises at least one entrance opening edge parallel to a side wall of a rear chamber.

10. The cartridge of claim 2 comprising at least one filter mount rib near an entrance of the standpipe in the rear chamber, being at least partly parallel to a side wall of the rear chamber.

11. The cartridge of claim 1 wherein the headland comprises at least four protrusions protruding from a surface of the headland to space the printhead die from the headland.

12. A replaceable tri-color ink cartridge, comprising
two rear chambers and one front chamber, each chamber for holding ink of a unique color;
a standpipe opening into one of the rear chambers at one end;
a plenum at an opposite end of the standpipe;
the plenum opening into a headland slot in a headland;
the headland having three parallel headland slots, each fluidically connected to a die feed slot; and
a printhead die attached to the headland, having
ink feed slots directly connected to the headland slots, and
nozzle arrays directly connected to the ink feed slots, wherein each nozzle array comprises at least approximately 340 nozzles in one column, having a nozzle pitch of approximately 43 microns or less, or each nozzle array provides for a resolution of at least approximately 600 dots per inch;
wherein a length of the headland slots is larger than a length of the ink feed slots, and the length of the ink feed slots is larger than a length of the nozzle arrays.

13. The cartridge of claim 12 wherein the length of the headland slots is at least 14.4 mm.

14. The cartridge of claim 12 wherein the headland slots have a length of approximately 15.9 mm, the feed slots have a length of approximately 15.6 mm, and the nozzle arrays have a length of approximately 14.4 mm.

15. The cartridge of claim 12, wherein the headland comprises four protrusions protruding from a surface of the headland to space the printhead die from the headland.

* * * * *